US009963938B2

(12) United States Patent
Foote et al.

(10) Patent No.: US 9,963,938 B2
(45) Date of Patent: May 8, 2018

(54) DIRECTIONAL DRILLING MOTOR

(71) Applicant: Cathedral Energy Services Ltd., Nisku (CA)

(72) Inventors: Dean Norman Foote, Edmonton (CA); John Kaminski, Nisku (CA); Jason Williams, Nisku (CA)

(73) Assignee: Cathedral Energy Services Ltd., Nisku, Alberta (CA)

( * ) Notice: Subject to any disclaimer, the term of this patent is extended or adjusted under 35 U.S.C. 154(b) by 174 days.

(21) Appl. No.: 14/887,731

(22) Filed: Oct. 20, 2015

(65) Prior Publication Data

US 2017/0044833 A1 Feb. 16, 2017

(51) Int. Cl.
*E21B 7/06* (2006.01)
*E21B 17/10* (2006.01)
*E21B 4/02* (2006.01)

(52) U.S. Cl.
CPC ..... *E21B 7/068* (2013.01)

(58) Field of Classification Search
CPC ..... E21B 7/068; E21B 7/067
See application file for complete search history.

(56) References Cited

U.S. PATENT DOCUMENTS 3,160,218 A * 12/1964 Crake ..... E21B 7/04 175/325.1
3,330,368 A * 7/1967 Baran ..... E21B 7/068 175/67
4,739,842 A * 4/1988 Kruger ..... E21B 7/068 175/325.2
4,880,067 A * 11/1989 Jelsma ..... E21B 4/02 175/107
RE33,660 E * 8/1991 Jelsma ..... E21B 4/02 175/107
5,042,597 A * 8/1991 Rehm ..... E21B 17/16 175/408
5,727,641 A * 3/1998 Eddison ..... E21B 7/068 175/76
5,857,531 A * 1/1999 Estep ..... E21B 4/02 175/101
2001/0022241 A1* 9/2001 Portman ..... E21B 4/006 175/61
2004/0211570 A1* 10/2004 Chen ..... E21B 7/067 166/382
2016/0123083 A1* 5/2016 Gaikwad ..... E21B 7/067 175/57
2017/0016277 A1* 1/2017 Lange ..... E21B 7/067
2017/0067301 A1* 3/2017 Lange ..... E21B 17/20

* cited by examiner

*Primary Examiner* — James G Sayre
(74) *Attorney, Agent, or Firm* — Davis & Bujold PLLC; Michael J. Bujold

(57) ABSTRACT

A drilling motor for directional drilling in a wellbore has a drill bit at a downhole end, a bent housing having a first bend spaced above the drill bit and defining a first angle, the first bend having an inside bend surface and an outside bend surface, and a guide element that biases the first bend toward the first angle when the bent housing is positioned within a straight section of the wellbore. The guide element may be a pad, a centralizer or a second bend in the bent housing.

24 Claims, 16 Drawing Sheets

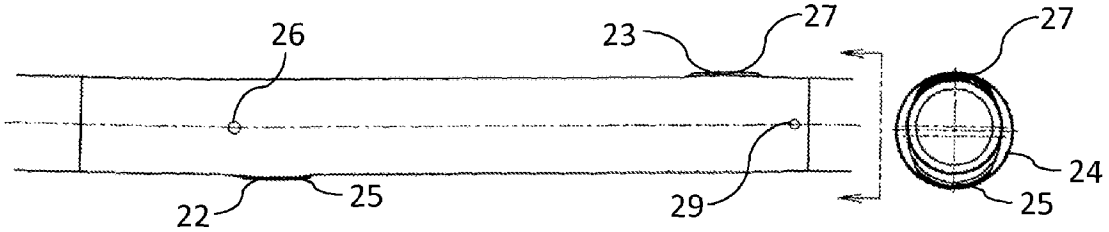
FIG. 14A
FIG. 14B
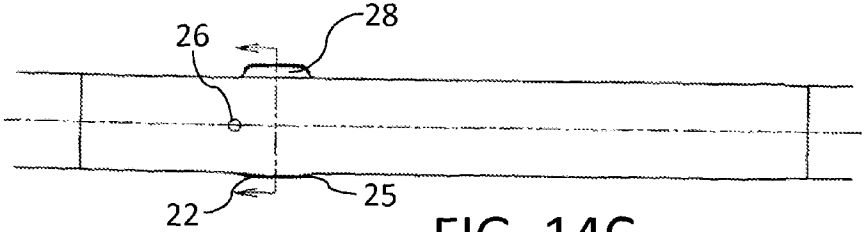
FIG. 14C
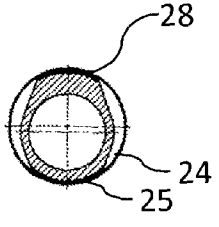
FIG. 14D
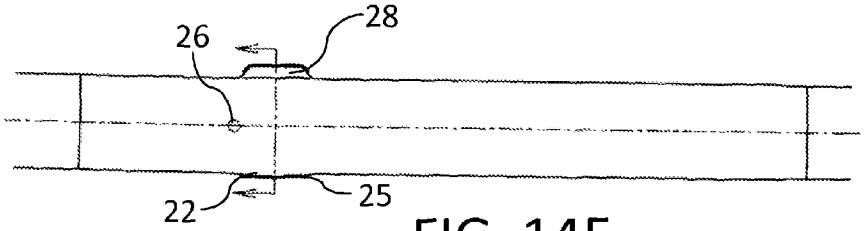
FIG. 14E
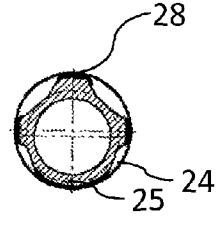
FIG. 14F

DIRECTIONAL DRILLING MOTOR

TECHNICAL FIELD

This relates to a directional drilling motor, such as a drilling motor that is attached to bottom end of a drill string with a drill bit attached to the bottom end.

BACKGROUND

A drilling motor with a bent housing is usually used in directional drilling. When the drilling motor has fluid pumped through it to provide rotation to the bit and the drill string and drilling motor is stationary, the drilled well bore follows a generally curved path in the direction of the bent housing. When the drilling motor has fluid pumped through it to provide rotation to the bit and the drill string and drilling motor is rotated, the drilled well bore follows a generally straight path due to the rotation of the bent housing.

The combination of the curved and straight path segments allows the directional control of a well bore to follow a predetermined course.

SUMMARY

According to an aspect, there is provided a drilling motor for directional drilling in a wellbore, the drilling motor having a drill bit at a downhole end, the drilling motor comprising a bent housing having a first bend spaced above the drill bit and defining a first angle, the first bend having an inside bend surface and an outside bend surface. A guide element biases the first bend toward the first angle when the bent housing is positioned within a straight section of the wellbore.

According to a further aspect, the guide element may comprise a pad positioned adjacent to the inside bend surface of the first bend, the pad biasing the outside bend surface toward an inner surface of the straight section of the wellbore. The pad may comprise a portion of a centralizer carried by the bent housing adjacent to the first bend.

According to a further aspect, the bent housing may comprise a second bend that is spaced above the first bend relative to the drill bit, and the guide element may further comprises the second bend. The drilling motor may further comprise a pad positioned adjacent to the inside bend surface of the first bend, the pad biasing the outside bend surface toward an inner surface of the straight section of the wellbore and the guide element may further comprise the pad.

According to an aspect, there is provided a drilling motor for directional drilling in a wellbore. The drilling motor has a drill bit at a downhole end. The drilling motor comprises a first housing section between the drill bit and a first bend, and a second housing section between the first bend and a second bend. The first housing section and the second housing section lie in a plane, wherein the first housing section lies in the plane on a first side of the second housing section. The drilling motor further comprises a third housing section extending away from the second bend relative to the second housing section, the third housing section extending away from the first side of the second housing section.

According to another aspect, the first housing section, the second housing section, and the third housing section each lie in the plane.

According to another aspect, the drilling motor further comprises a wear pad on an outside surface of at least one of the first bend and the second bend.

According to another aspect, the drilling motor further comprises a pad on an inside surface of the first bend, the positioning pad being sized to maintain the first bend above a minimum angle within the wellbore.

According to another aspect, the first bend has an angle of about 1.5 degrees and the second bend has an angle of about 1 degree.

According to another aspect, a respective length of the first, second and third housing sections and a respective angle of the first and second bends result in a side load at the bit of less than about 300 lbs, a side load at the bit of less than about 150 lbs, or substantially no side load at the bit when the housing is in a straight section of the wellbore.

According to another aspect, there is provided a method of directional drilling. The method comprises the steps of attaching a drill bit to a motor housing of a downhole drilling motor as described above; drilling a curved section of the borehole by operating the drill bit while maintaining the motor housing in a fixed rotational position within the borehole, the curved section being in the direction of the first bend; and drilling a straight section of the borehole by operating the drill bit while rotating the motor housing relative to the borehole.

According to an aspect, there is provided a drilling motor for directional drilling in a wellbore, the drilling motor having a drill bit at a downhole end. The drilling motor comprises a bent housing having a first bend spaced above the drill bit and defining a first angle, the first bend having an inside bend surface and an outside bend surface; and a pad adjacent to the inner surface of the first bend, the pad biasing the first bend toward the first angle when the bent housing is positioned within a straight section of the wellbore.

According to an aspect, the pad may comprise a portion of a centralizer carried by the bent housing adjacent to the first bend.

According to an aspect, the drilling motor may further comprise a second bend positioned above the first bend relative to the drill bit, the second being having a second angle that is opposite the first angle.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are hot intended to be in any way limiting, wherein:

FIG. 14A-14F are three combinations of bends and pads to be placed in the drilling motor.

DETAILED DESCRIPTION

Figures 1A, 1B, 1C, 1D:
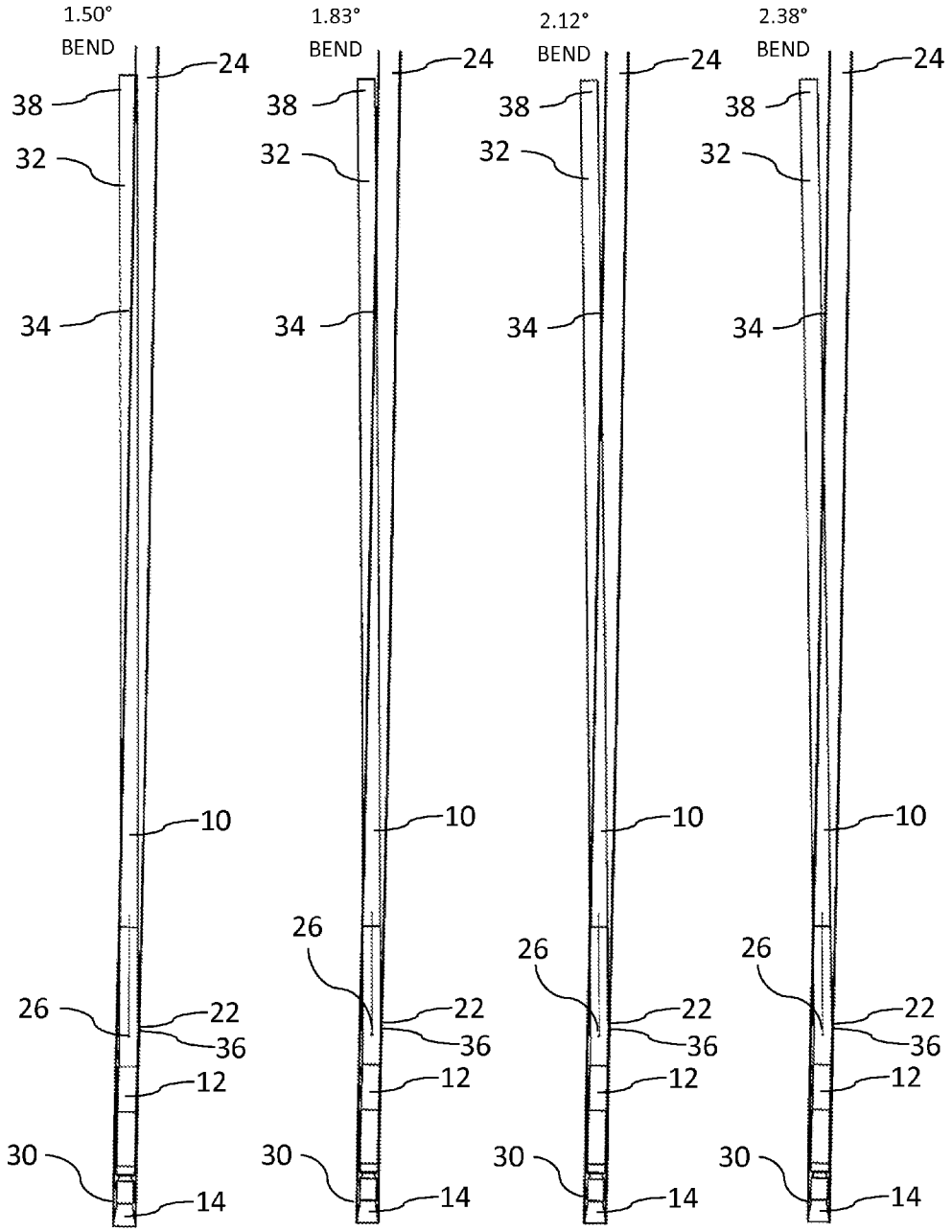
FIG. 1A PRIOR ART
FIG. 1B PRIOR ART
FIG. 1C PRIOR ART
FIG. 1D PRIOR ART
FIG. 1A-1D are side elevation views of prior art drilling motors in a well bore.
Figures 2A, 2B, 2C, 2D:
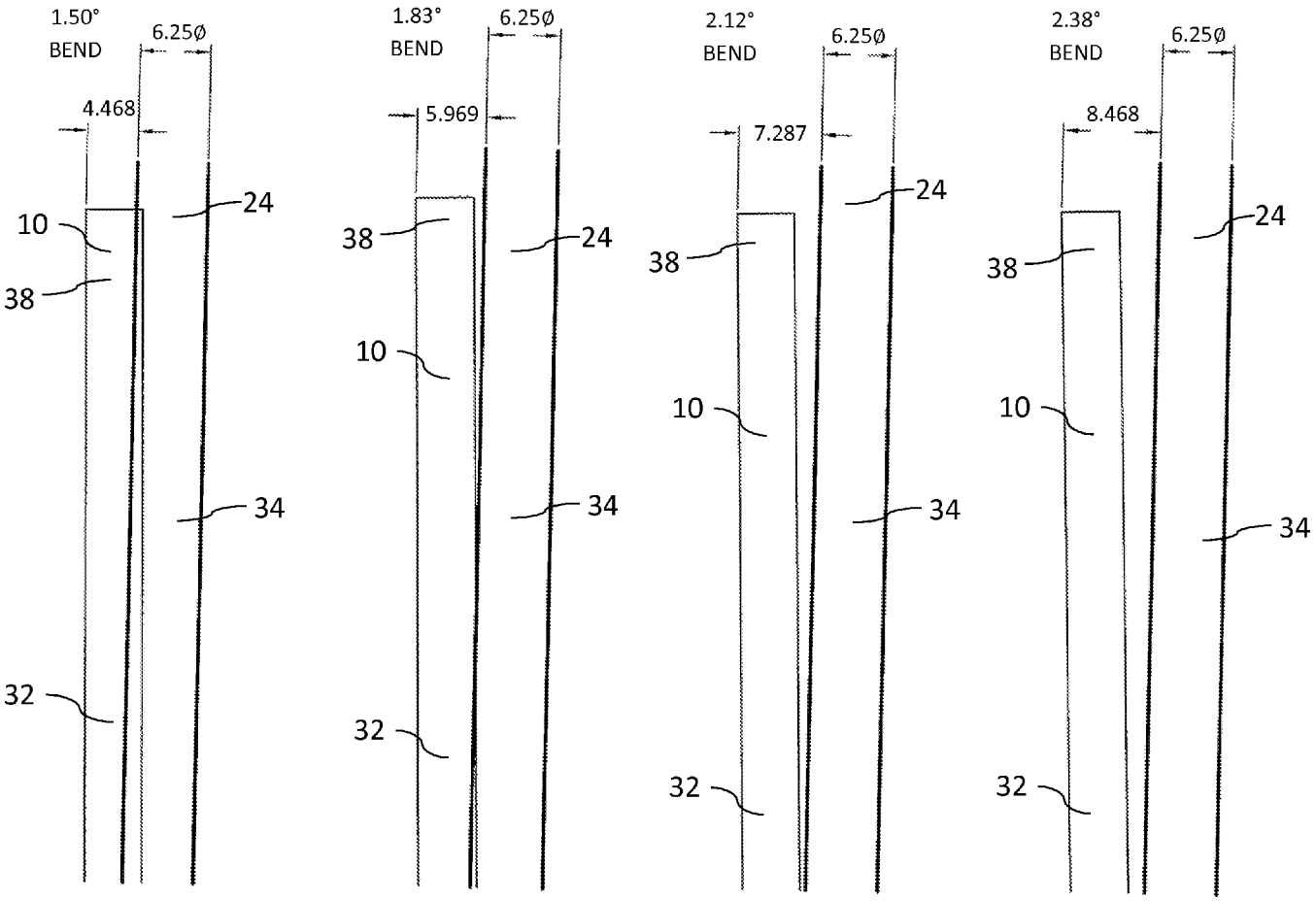
FIG. 2A PRIOR ART
FIG. 2B PRIOR ART
FIG. 2C PRIOR ART
FIG. 2D PRIOR ART
FIG. 2A-2D are detailed side elevation views of drilling motors in well bores showing the well bore interference for the different bends shown in FIG. 1A-1D.

Referring to FIG. 1A-1D, there is shown a drilling motor, generally identified by reference 10. Drilling motor 10 is designed with a bend 26 that enable motor 10 to drill a well bore 24 with a curved section 30 when the drill pipe 32 and drilling motor 10 are held rotationally stationary. The curved section 30 of well bore 24 that is produced by drilling motor 10 when weight is applied to the top of drilling motor 10 is generally determined by the magnitude of bend 26. FIG. 1A-1D show four bends, 1.50°, 1.83°, 2.12°, and 2.38°. With each bend 26, there is an interference that drilling motor 10 experiences when inserted into a straight section 34 of well bore 24. Due to their length, a drilling motor 10, with a typical bend 26, will not "fit" in straight section 34 of well bore 24. FIG. 2A-2D represent the resulting interference at the top of the drilling motor 10 for each bend. As can be seen, drill bit 14 is centralized in the well bore 32 and the "low" side of the bend 26 is in contact with the wall of straight section 34 of well bore 24, usually with a wear resistant pad 36 providing the contact point 22. Drilling a curved section 30 in a well bore 24 to change its direction is dependent on the magnitude of the interference resulting from the selected bend. Larger bends, resulting in greater interferences, generally drill sharper curves to produce larger changes in the well bore direction. This method of directional drilling requires three points of contact to induce the appropriate side loading and produce the desired curve in the well bore. The three points are (1) the centralized bit 14 in the well bore 24, (2) the "low" side of the bend 22, in contact with the wall of well bore 24, and (3) the top 38 of the drilling motor 10 in contact with the wall of well bore 24.

Figure 3A:
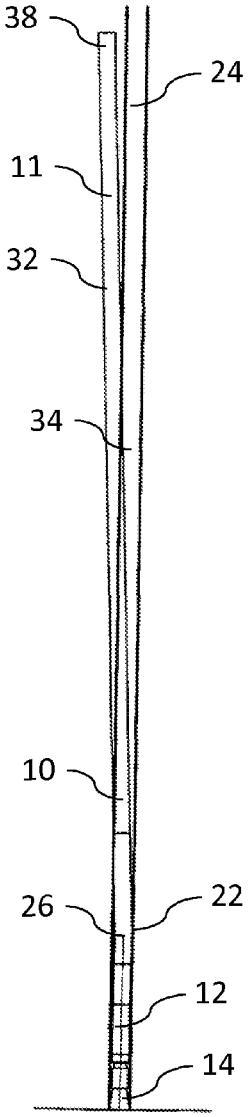
FIG. 3A PRIOR ART
FIG. 3A-3C are progressive side elevation views with approximated applied loads to fit the drilling motor into the well bore with a bend of 2.38°.
Figure 3B:
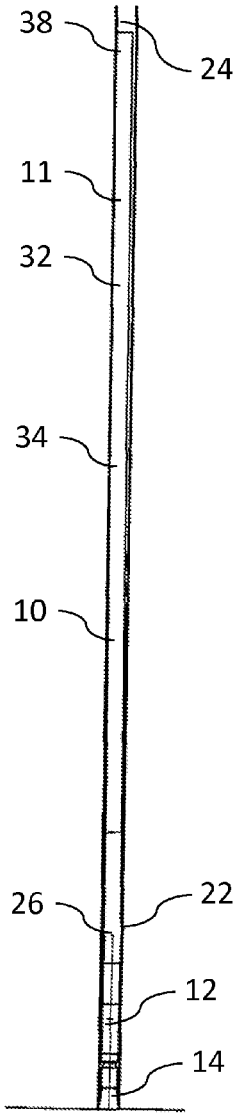
FIG. 3B PRIOR ART
Figure 3C:
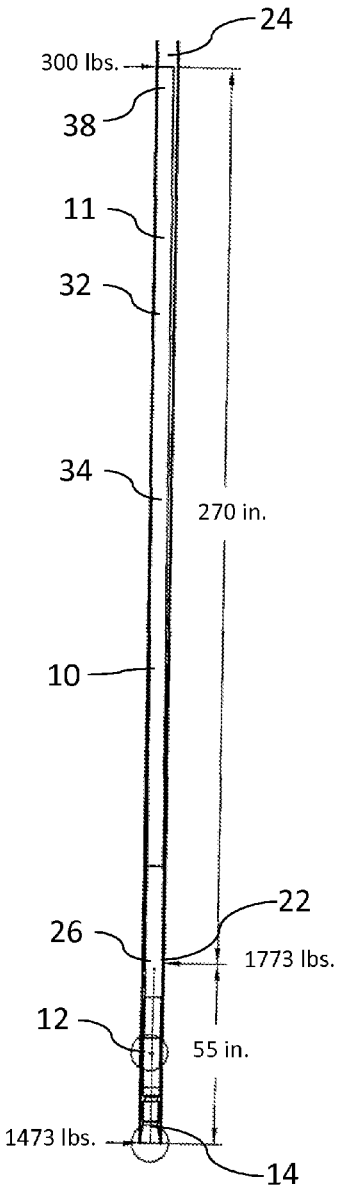
FIG. 3C PRIOR ART
Figures 4A, 4B, 4C:
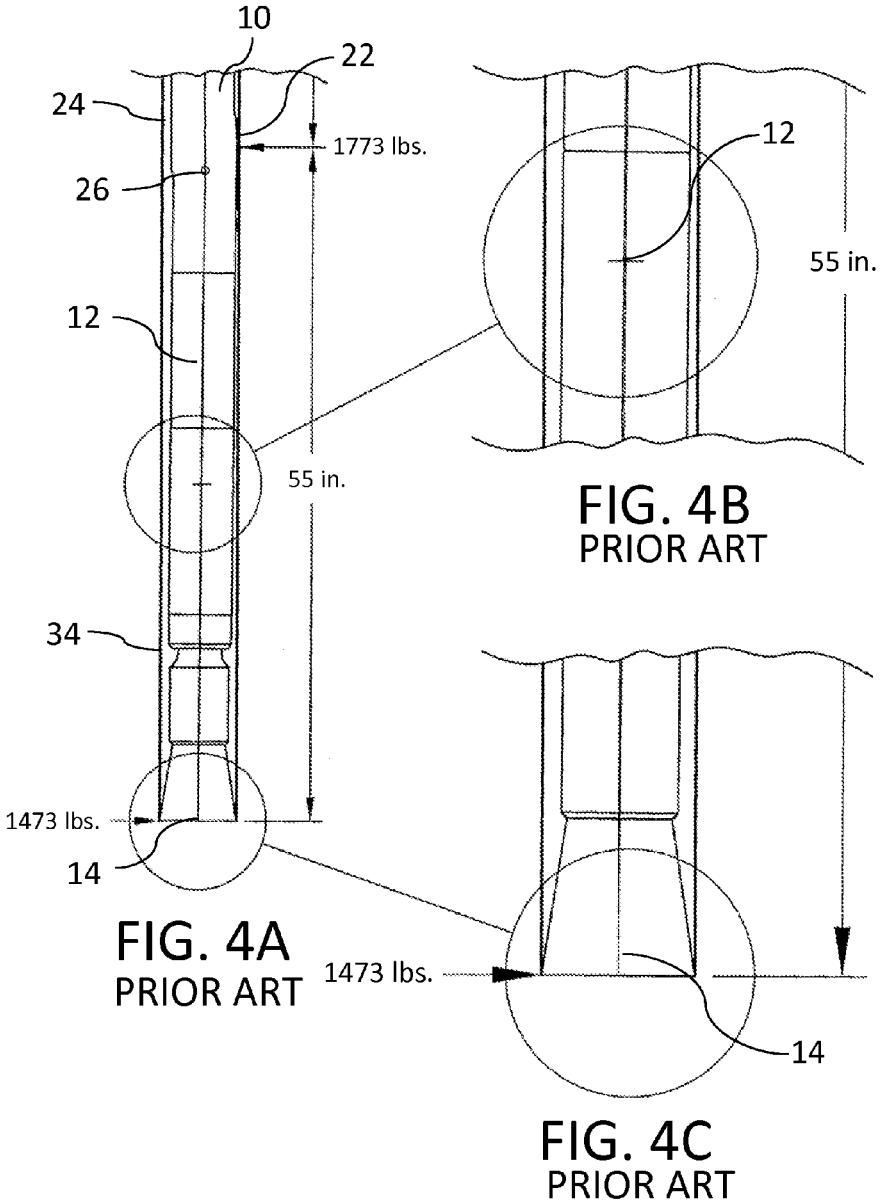
FIG. 4A PRIOR ART
FIG. 4B PRIOR ART
FIG. 4C PRIOR ART
FIG. 4A-4C are side elevation views of the lower section of the drilling motor and bit with approximated applied loads shown in FIG. 3C.
Figure 5:
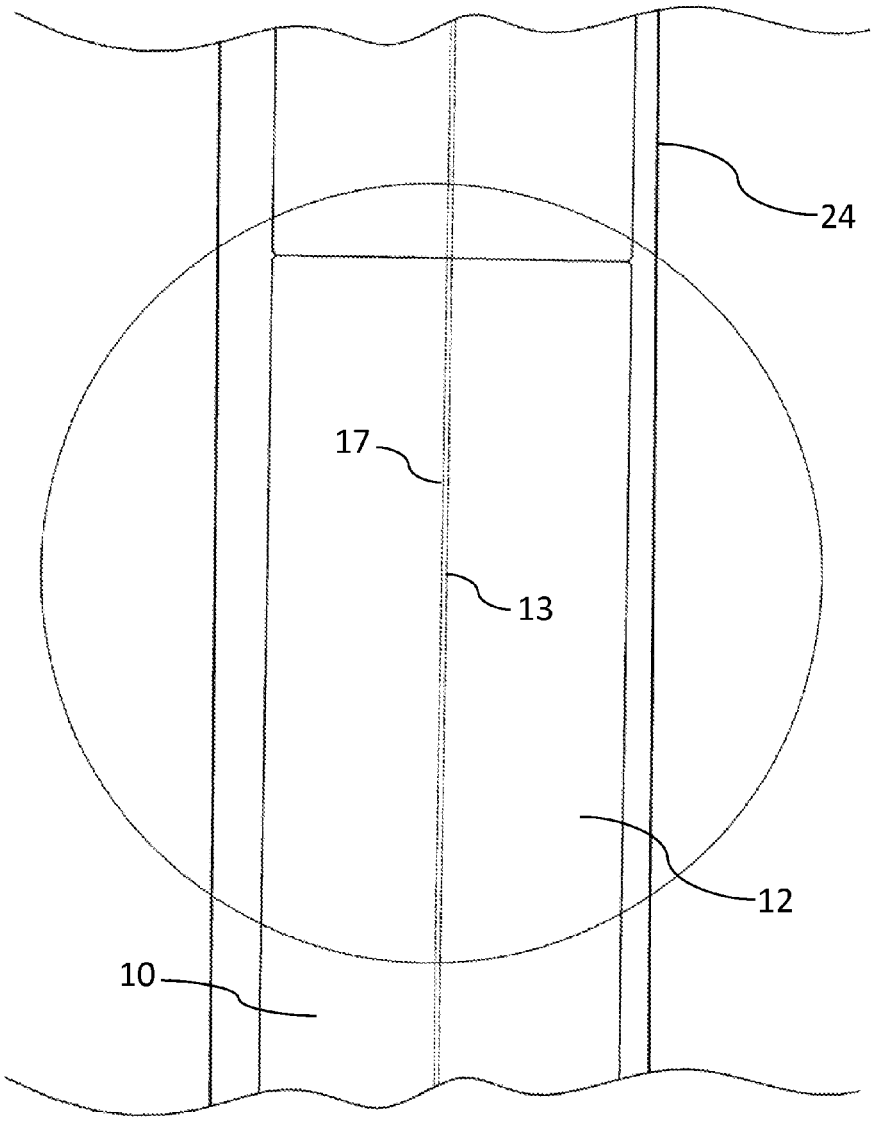
FIG. 5 PRIOR ART
FIG. 5 is an enlarged side elevation view of the approximate mid-point of the lower section of the drilling motor in FIG. 4A-4C indicating the resulting axial flex of the lower tubular section when fitted into the well bore.
Figure 6B:
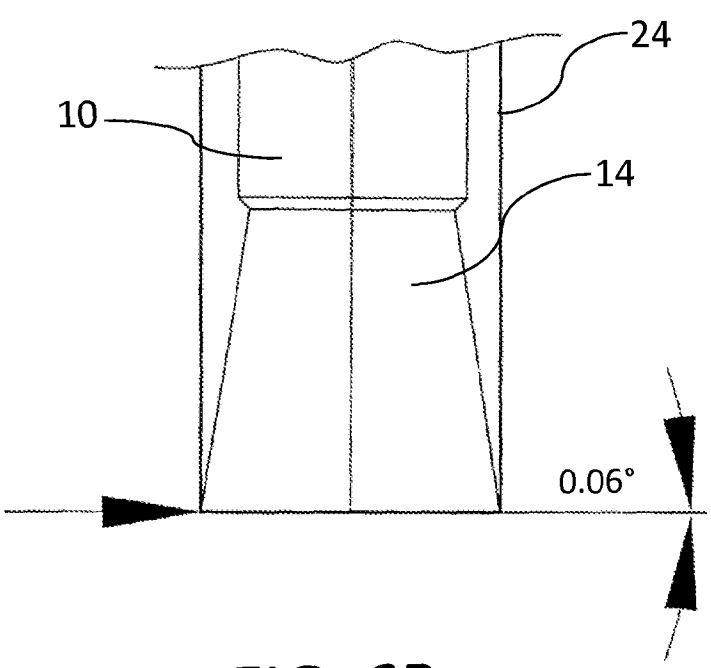
FIG. 6B PRIOR ART
FIGS. 6A and 6B are an enlarged side elevation view of the bit in FIG. 3A-3C and an approximate change in the bit face angle relative to a plane that is normal to the well bore.
Figure 6A:
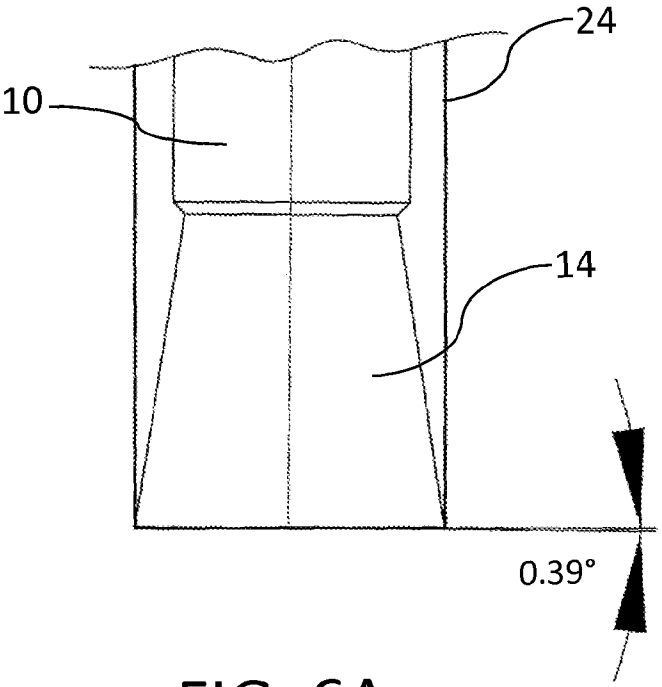
FIG. 6A PRIOR ART

FIG. 3A-3C represent the applied physical forces required to "fit" a drilling motor with a 2.38° bend into the straight section 34 of well bore 24. FIG. 3 shows an example of the resulting side loads at each of the 3 contact points. In particular, there is shown a drilling motor that is 325 inches with a bit 14 that is 55 inches from bend 22. The top tubular portion 11 of drilling motor 10 flexes when inserted into the straight section 34 of well bore 24. For this discussion, it is assumed that the force required to fit the drilling motor into the straight section 34 of well bore 24 remains at the top 38 of the drilling motor 10, and is estimated to be 300 lbs. The estimated 300 lbs load at the top 38 of the drilling motor 10 produces a load on the side of the bit 14, of 1473 lbs and a contact load on the "low" side of bend 22 of 1773 lbs. FIGS. 4A and 4B are enlarged details of the loading and resulting flex the lower tubular portion 12 experiences when fit into the straight section 34 of well bore 24. FIG. 5 is an enlarged view of the centre axis 13 of the lower tubular section 12, and the flex of the centre axis 13 to the measured axis position 17 when the drilling motor 10 is fit into the well bore 24. The bit 14 accommodates side loading, but is not restricted from rotating due to the flexing of the tubular section 12. Approximated from actual measurements, FIGS. 6A and 6B represent the change in the angle of bit 14 when the drilling motor 10 is fit into well bore 24. That is to say that, the centralized bit 14 and the contact point 22 in FIG. 1A-1D position the bit 14 at an angle of 0.39°, relative to straight section 34 of well bore 24. When drilling motor 10, with a 2.38° bend 26, is fit into straight section 34, the face of bit 14 rotates from 0.39° to 0.06° due to the loads imposed by straight section 34. Because the face of bit 14 flattens as drilling motor 10 is fit into straight section 34, the ability to produce a curve in well bore 24 when drilling ahead is greatly diminished. This trend is particularly noticeable in hard-rock formations with PDC (polycrystalline diamond cutter) bits, because they drill sideways effectively. Currently, the trend is to use larger bends, 2.50° or higher. This solution increases the side loading on bit 14, which in turn increases the loads on lower tubular portion 12 of drilling motor 10. These increased loads often result in failures of the drilling motor 10.

Figures 7A, 7B, 7C, 7D:
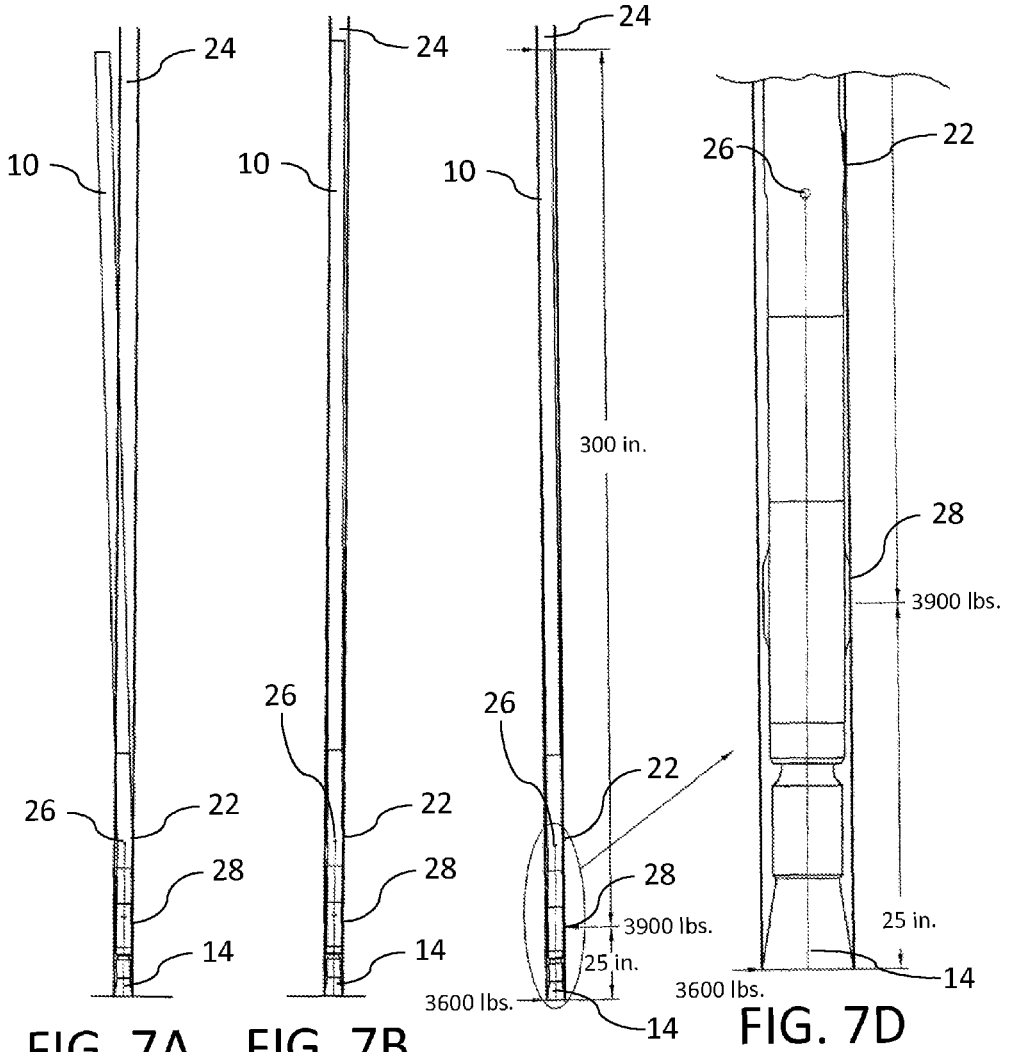
FIG. 7A PRIOR ART
FIG. 7B PRIOR ART
FIG. 7C PRIOR ART
FIG. 7D PRIOR ART
FIG. 7A-7D are representations of a drilling motor with a stabilizer or pad located between the bend and the bit, and the resulting side loads.
Figures 8A, 8B, 8C, 8D:
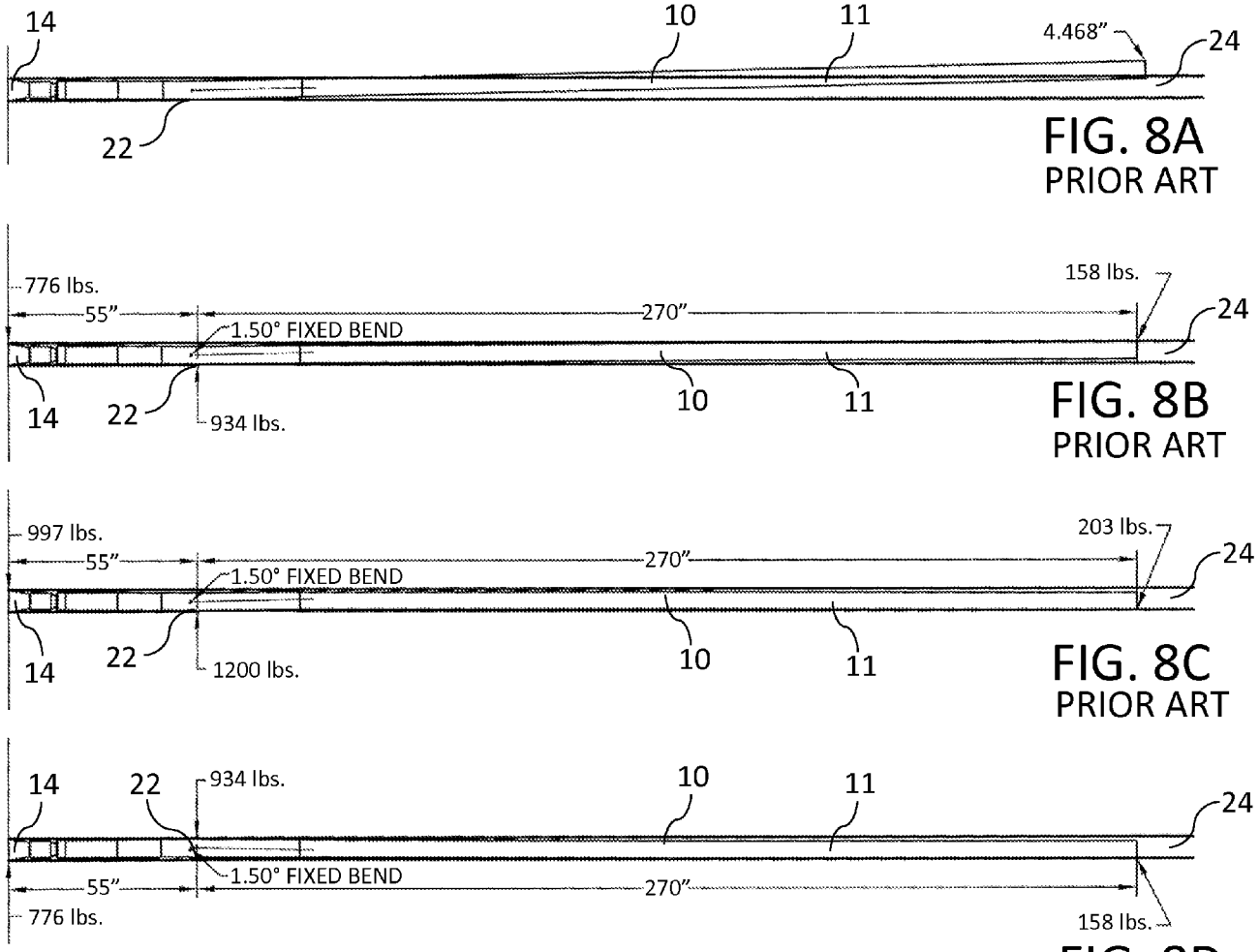
FIG. 8A PRIOR ART
FIG. 8B PRIOR ART
FIG. 8C PRIOR ART
FIG. 8D PRIOR ART
FIG. 8A-8D are representations of a drilling motor in a horizontal well and the resulting side loads as the motor rests on the bottom of the well as a result of its weight.

FIG. 7A-7D represent another method used to increase the side loading of bit 14, with a "near bit" pad or stabilizer 28. To be effective, the pad or stabilizer 28 must contact the well bore 24 before the bend contact point 22. This being the case, the loading on bit 14 and pad or stabilizer 28 is greatly increased as shown in FIGS. 7C and 7D. Horizontal drilling of a well bore also provides insight into the limitations of the 3-point contact method. FIG. 8A-8D represent the pertinent considerations of a drilling motor 10 in a well bore 24. FIG. 8C represents the effect of the weight of tubular section 11 of drilling motor 10, and the added weight of tubular section (not shown) attached above drilling motor 10 in horizontal well 24. The top of drilling motor 10 rests on the bottom of the well bore, increasing the side load on bit 14, and the contact point 22 of the drilling motor 10. FIG. 8D indicates the loading when the contact point 22 is in contact with the top of the well bore. The top of the drilling motor 10 remains on the bottom of the well bore 24 and the loading on bit 14 and contact point 22 are reduced. When drilling motor 10 is rotated to drill a straight section, the 3-point method shown in FIG. 8A-8D causes the well bore 24 to turn in a direction that is "up" and "left". The "up" directional portion is due to the uneven loading as drilling motor 10 rotates in the horizontal section and reaches higher side loads at bit 14 when contact point at bend 22 is on the bottom of well bore 24. The left directional portion is due to the right hand rotation of drill bit 14, and the increased side load on bit 14, as it nears and reaches the top of well bore 24 in rotation of the drill string and drilling motor 10. FIGS. 8C and 8D represent the change in the side loading of bit 14 as the bend contact point 22 reaches the bottom and top of well bore 24.

Figures 9A, 9B, 9C, 9D:
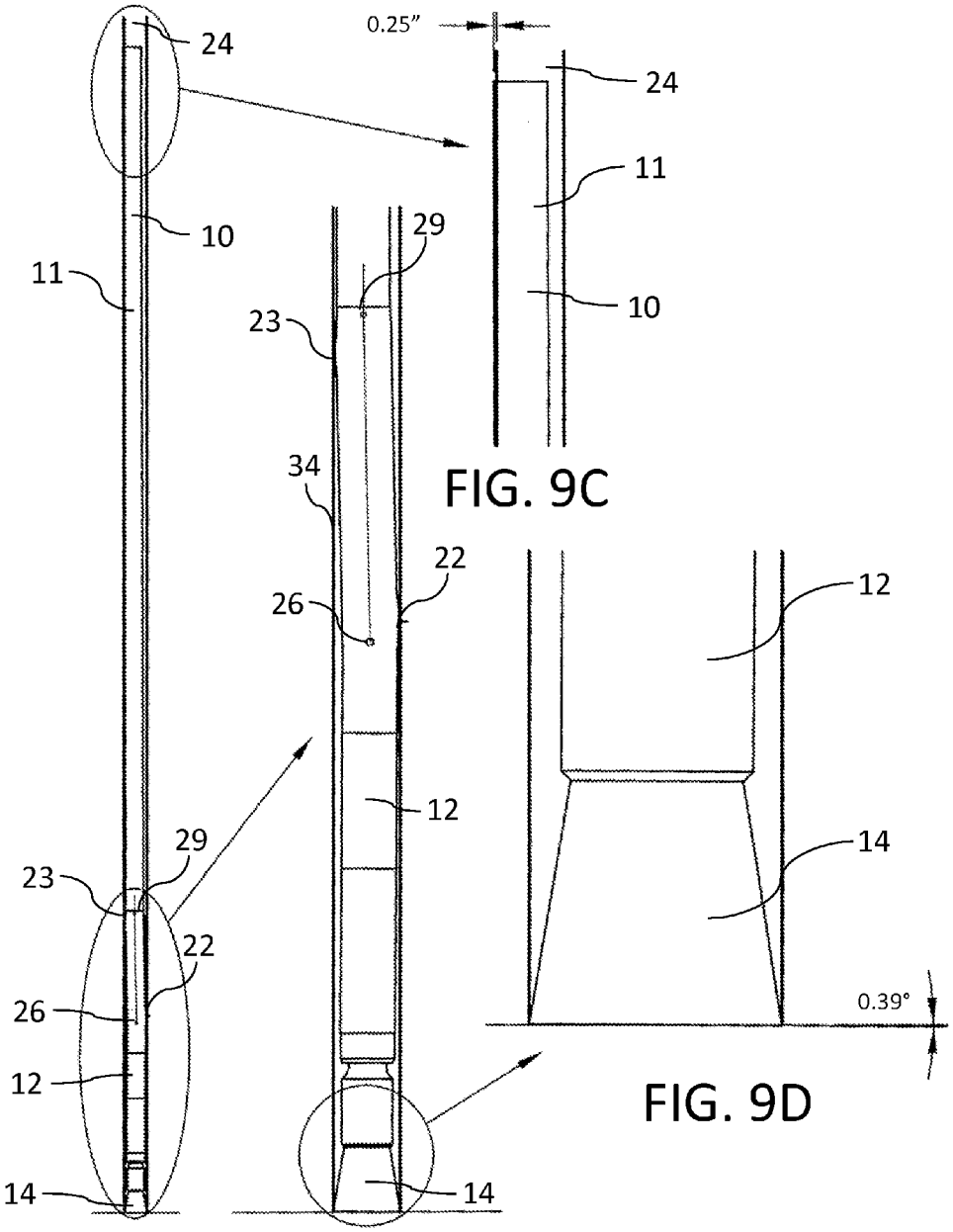
FIG. 9A-9D are representations of a "double bend" drilling motor where the bends are opposing, with the lower bend being 1.50° and the upper bend being 1.00° in a direction 180° to the 1.50° bend.
Figures 10A, 10B, 10C, 10D:
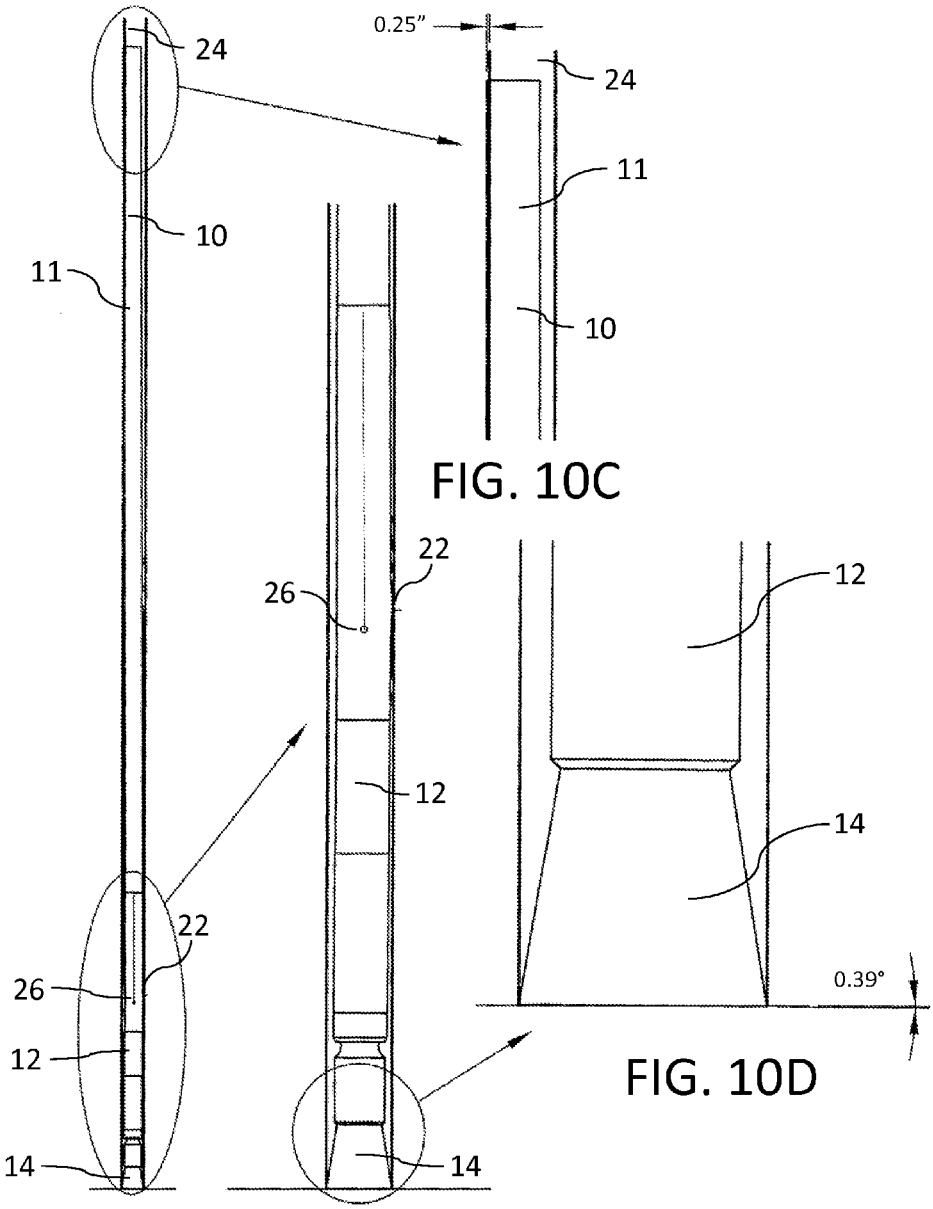
FIG. 10A-10D are representations of a single bend drilling motor where the bend is reduced to achieve the same interference at the top of the drilling motor and maintain the same bit face angle as the double bend motor in FIG. 9A-9D.

FIG. 9A-9B represents an alternate approach to the 3-point contact method. Drilling motor 10 is fit with two bends 26 and 29 to provide an improved method for directional drilling well bore 24. FIG. 9A shows drilling motor 10 with a bit 14 attached to the bottom. Drilling motor 10 has a first bend 26, for example 1.50° as shown, with a second bend 29 and a second contact point 23 placed a short distance above first bend 26, for example 1.00° in the opposite the direction of first bend 26. FIG. 9B is an enlarged view of the lower tubular section 12, with bends 26 and 29 and contact points 22 and 23. At second bend 29, there is a second contact point 23. With the angles and lengths selected, second contact point 23 as shown is not in contact with well bore wall in straight section 34 of well bore 24, but will contact the wall of well bore 24 when the well is curved to change direction. FIG. 9C represents the interference at the top of drilling motor 10 of 0.25", with the depicted double bend configuration. Other angles and other lengths may result in more or less than this, but should be designs such that the interference is less than would otherwise be the case in a single bend design. In the depicted example, the corresponding load to "fit" the top of the drilling motor 10 into well bore 24 is 9 lbs. This interference is small compared to the 3-point method discussed earlier and, if desired, may be completely eliminated by increasing the magnitude of upper bend 29. FIG. 9D represents the angle of bit 10, with the double bend configuration and will remain at 0.39° with a side load on bit 14 of 43 lbs.

Figure 11A:
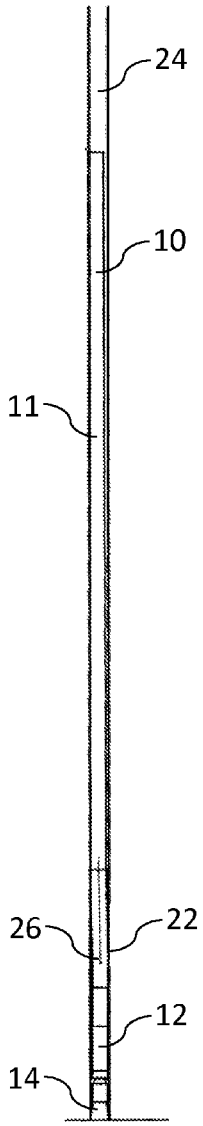
FIG. 11A-11D are representations of a well bore, drilled 39" with the single bend drilling motor in FIG. 10A-10D.
Figure 11B:
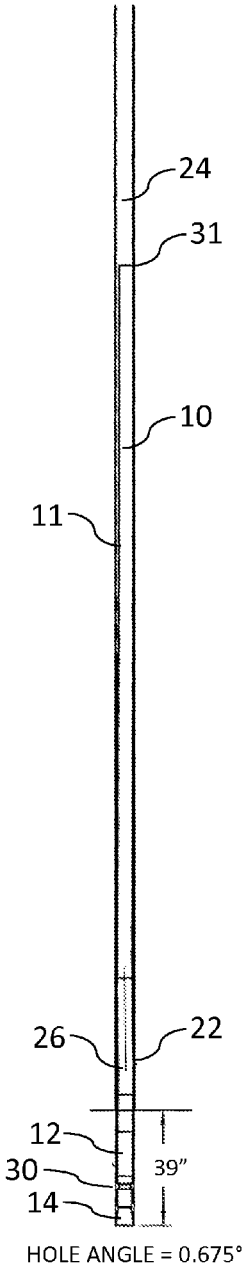
Figure 11C:
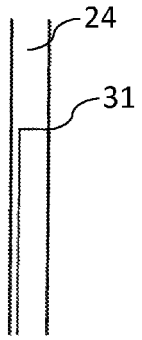
Figure 11D:
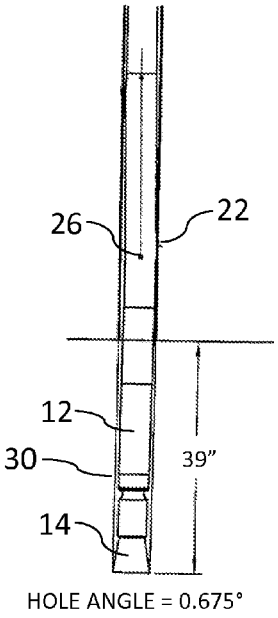
Figure 12A:
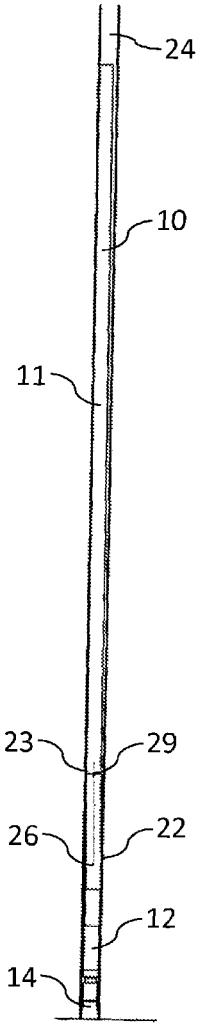
FIG. 12A-12D are representations of a well bore, drilled 39" with the double bend drilling motor in FIG. 9A-9D.
Figure 12B:
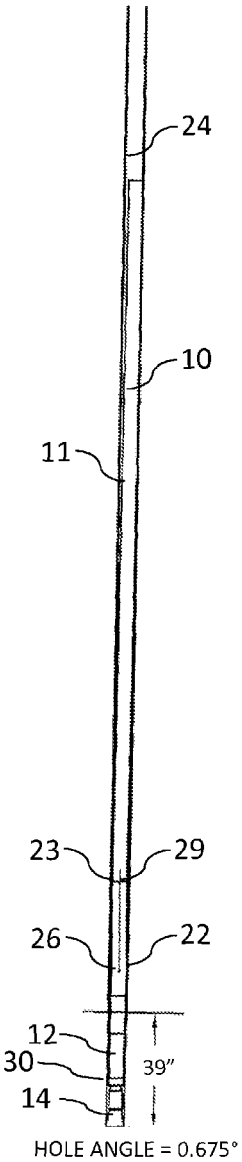
Figure 12C:
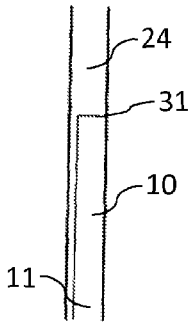
Figure 12D:
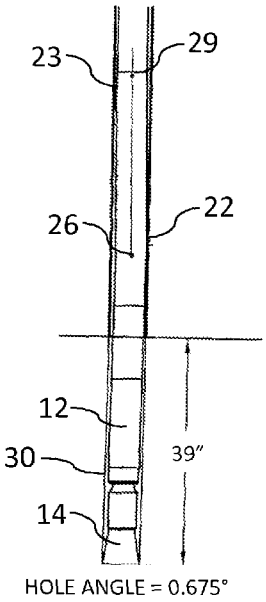
Figure 13A:
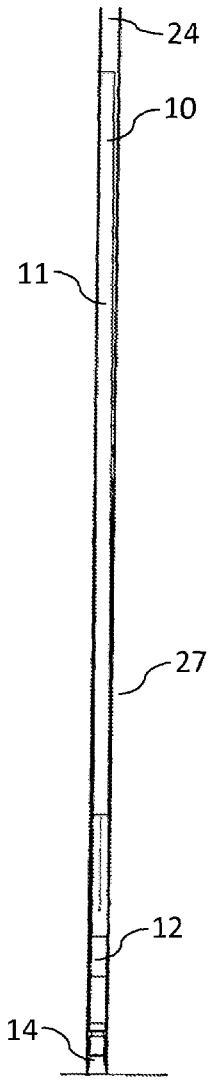
FIG. 13A-13D are representations of a well bore, drilled 39" with the single bend drilling motor in FIG. 10A-10D, with the addition of a pad opposite the bend on the high side.
Figure 13B:
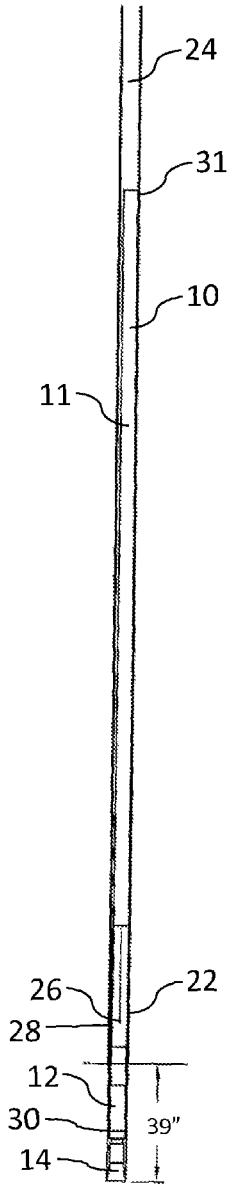
Figure 13C:
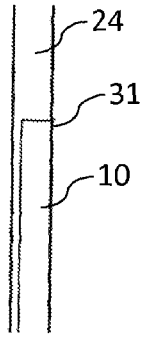
Figure 13D:
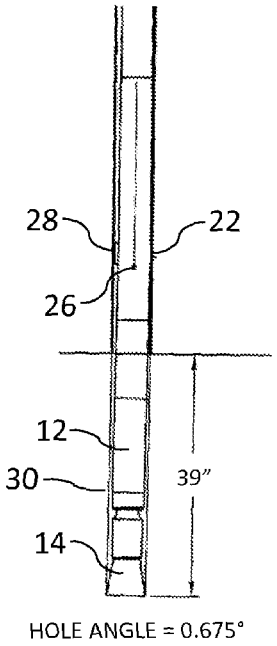
Figure 15A:
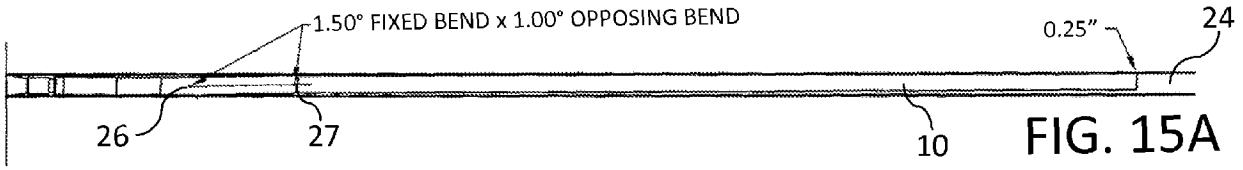
FIG. 15A-15D are a representation of the side loads resulting from a double bend drilling motor with a 1.50° bend combined with a 1.00° in the opposite direction.
Figure 15B:
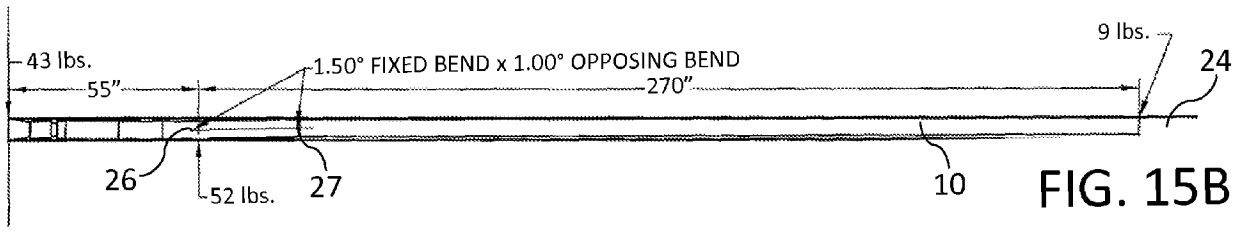
Figure 15C:
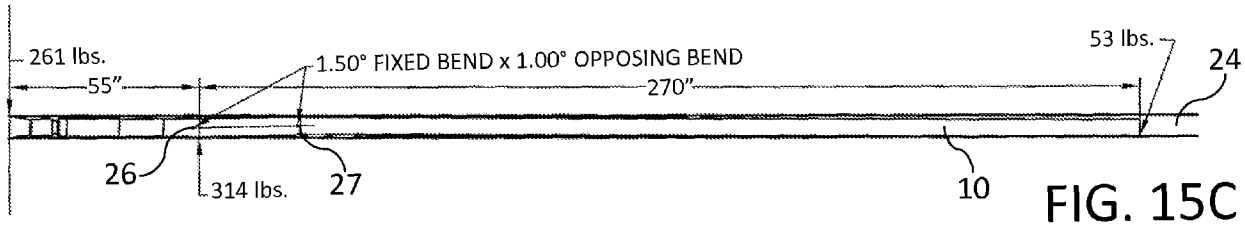
Figure 15D:
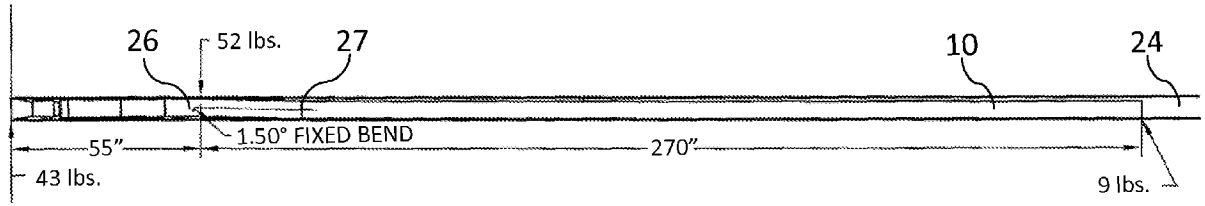

FIG. 10A-10D represents a further alternate method to reduce side loading in the 3 point contact method. In the depicted example, bend 26 is reduced to 0.61°, which results in the same interference at the top of drilling motor 10 as the double bend drilling motor in FIG. 9A. FIG. 11A-11D demonstrates the ability of drilling motor 10 in FIG. 10A to effectively curve the well bore 24 after drilling ahead for approximately 39" without rotating. FIGS. 11B and 11C show how drilling motor 10 follows curved well bore 24, until the top of the drilling motor 10 contacts the wall 31 of well bore 24. Continued drilling would create interference at the top of the drilling motor until contact point 22 at bend 26 is no longer in contact with well bore 24. When this occurs, bit 14 begins to lose angle and the curves section 30 of well bore 24 begins to straighten. This is undesirable when trying to change the direction of well bore 24. FIG. 12A-12D represents the drilling motor 10 in FIG. 11A, drilling the same distance. Continued drilling with this embodiment does not produce the same result as seen in FIG. 11A because contact point 23 prevents drilling motor 10 from straightening. Curved section 30 in well bore 24 will continue as the same bit angle is maintained. FIG. 13A-13D represents an alternate method to allow drilling motor 10 in FIG. 11A to maintain the proper angle on the face of bit 10 when drilling a curved section 30. Drilling motor 10 in FIG. 13A-13D is fitted with a pad 28 on the opposite side of contact point 22. Pad 28 has a slight clearance to well bore 24, when point 22 is in contact with well bore 24. When a curved section 30 is drilled beyond 39", the top of drilling motor 10 will be in contact with well bore 24, and wall 31 cannot cause the face of bit 10 to flatten due to the presence of the pad 28.

FIG. 14A-14F represent additional ways to secure the position of bend 26, in relation to centralized bit 14, and minimize the side loading on the lower tubular section 12 of drilling motor 10. FIGS. 14A and 14B depict a double bend configuration with 1.50° on bottom bend 26 and 1.00° on top bend 29, in the opposite direction of the 1.50°. The net effect is a 0.50° degree bend with an upper pad 27 at contact point 23, to prevent the drilling motor 10 from lifting the low side pad 25 at contact point 22 from the well bore wall 24, when generating a curved section 30 in the well bore 24. FIGS. 14C and 14D depict a single bend with a pad 28 on the inside bend surface, directly opposite the "low" side pad 22, i.e. on the outside bend surface, to prevent the drilling motor, 10, from lifting the "low" side pad from the well bore wall, 24. FIGS. 14E and 14F depict an "offset" stabilizer at the bend 26, which keeps that point in a fixed relation relative to centralized bit 14 in any orientation. All three methods ensure that bend point 26 is off the central axis of well bore 24 to "tip" the bit 14 at an angle and enable the lower tubular section 12 to generate a curved portion 30 in well bore 24 when drilling motor 10 is not rotated. The smaller bend 26 results in reduced interference at the top of the drilling motor 10 and ensures that the side loading at contact point 22 and bit 14 remain minimal. The reduced loading in turn ensures lower tubular section 12 is not significantly "flexed" to change the angle of the face of bit 14. It should be noted that the angles used in this explanation are a result of the geometry and size of the drilling motor, 10, and the well bore 24. Other angles may be used by design and physical parameters, or within a range of side loads that are sufficiently low to avoid undesirable straightening of bit 14.

Figure 16A:
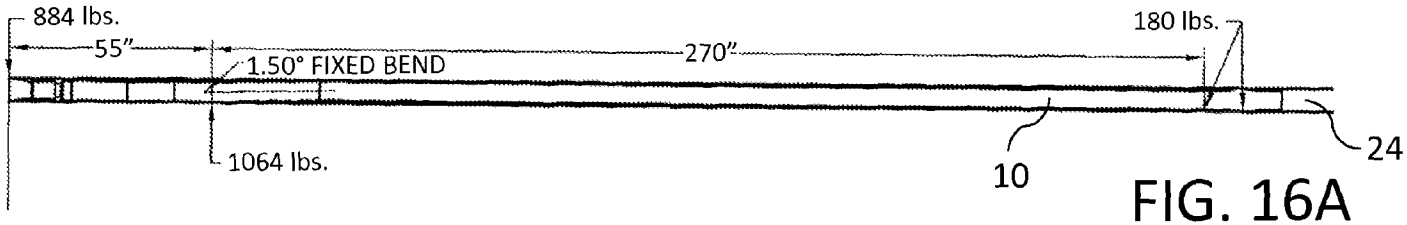
FIG. 16A PRIOR ART
FIG. 16A-16B are a representation of the side loads resulting from the two methods with the addition of a centraliser on top of the drilling motor in a horizontal well.
Figure 16B:
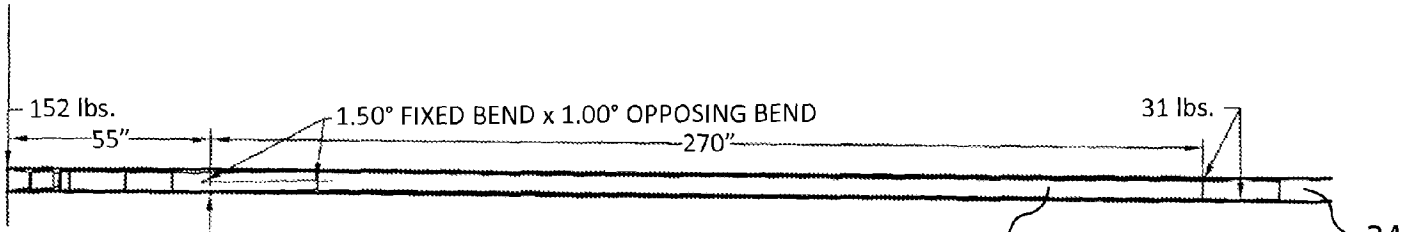

FIG. 15A-15D represent the results of the loading analysis of one embodiment when positioned in a horizontal well bore 24. The double bend motor 10 shown in FIG. 14A is used as a representation, and the resulting loads do not consider the stiffness or weight of the tubular members. It can be seen that the side loading at the contact points is greatly reduce in all cases as compared to the 3 point loading method discussed with respect to FIG. 8A-8D. These reduced loads result in a straighter well bore 24 when drilling motor 10 is rotated to drill ahead. FIGS. 16A and 16B represent a comparison between the two methods discussed in a horizontal well, with the addition of a centralizing tool added to the top of the drilling motor 10. FIG. 16A is the 3-point method used in the prior art and results in much higher side loads. FIG. 16B is uses a double bend design to reduce the side loading. It will be understood that design changes could reduce these loads to 0 lbs if desired. Additionally, larger bends could be chosen that increase the side loading to within an acceptable range that still maintains a suitable bit face angle. It will be also understood that one or both of bends 26 and 29 may be either adjustable or fixed angle bends.

While particular angles have been discussed above, it will be understood that these angles may be set according to the requirements of the situation. In some embodiments, the bends in drilling motor 10 may be adjustable, whereas in others, the bends may be set. Furthermore, using the principles described above, the specific geometry of the bends, including the angles of the bends and the length of the housing between the bit and the first bend and between the first and second bends, may be designed to achieve a desired angle of curvature of the curved section of the wellbore when drilling motor 10 is not rotating. As the angle of bit 14 will be more predictable and consistent, it may be necessary to adjust the operating procedures, which may be designed to take into account some side-loading initially.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A drilling motor for directional drilling in a wellbore, the drilling motor having a drill bit at a downhole end, and the drilling motor comprising:

a bent housing having a first bend spaced above the drill bit and defining a first angle, and the first bend having an inside bend surface and an outside bend surface;

a drill string connection opposite the downhole end that connects directly to a drill string, and the bent housing defining a fixed angle between the drill string and the drill bit; and a pad adjacent to the inside bend surface of the first bend, and the pad biasing the first bend toward the first angle when the bent housing is positioned within the wellbore.

2. The drilling motor of claim 1, wherein the pad comprises a portion of a centralizer carried by the bent housing adjacent to the first bend.

3. The drilling motor of claim 1, further comprising a second bend positioned above the first bend relative to the drill bit, and the second bend having a second angle that is opposite the first angle.

4. The drilling motor of claim 1, wherein a length of the bent housing between the drill bit and the first bend, and the angle of the first angle result in a side load at the bit of less than about 300 lbs in a straight section of the wellbore.

5. The drilling motor of claim 1, wherein a length of the bent housing between the drill bit and the first bend, and the angle of the first angle result in a side load at the bit of less than about 150 lbs in a straight section of the wellbore.

6. The drilling motor of claim 1, wherein a length of the bent housing between the drill bit and the first bend, and the angle of the first angle result in substantially no side loading at the bit in a straight section of the wellbore.

7. The drilling motor of claim 1, comprising a wear pad on an outside bend surface of the first bend.

8. A drilling motor for directional drilling in a wellbore, the drilling motor having a drill bit at a downhole end, the drilling motor comprising:

a first housing section between the drill bit and a first bend;

a second housing section between the first bend and a second bend, the first housing section and the second housing section lying in a plane wherein the first housing section lies in the plane on a first side of the second housing section; and a third housing section extending away from the second bend relative to the second housing section, the third housing section extending away from the first side of the second housing section.

9. The drilling motor of claim 8, wherein the first housing section, the second housing section, and the third housing section each lie in the plane.

10. The drilling motor of claim 8, comprising a wear pad on an outside surface of at least one of the first bend and the second bend.

11. The drilling motor of claim 8, comprising a pad on an inside surface of the first bend, the positioning pad being sized to maintain the first bend above a minimum angle within the wellbore.

12. The drilling motor of claim 8, wherein a respective length of the first, second and third housing sections and a respective angle of the first and second bends result in a side load at the bit of less than about 300 lbs in a straight section of the wellbore.

13. The drilling motor of claim 8, wherein a respective length of the first, second and third housing sections and a respective angle of the first and second bends result in a side load at the bit of less than about 150 lbs in a straight section of the wellbore.

14. The drilling motor of claim 8, wherein a respective length of the first, second and third housing sections and a respective angle of the first and second bends result in substantially no side loading at the bit in a straight section of the wellbore.

15. A method of directional drilling, the method comprising the steps of:

attaching a drill bit to a motor housing of a downhole drilling motor, the motor housing comprising:

a bent housing having a first bend spaced above the drill bit and defining a first angle, the first bend having an inside bend surface and an outside bend surface; and a pad adjacent to the inside bend surface of the first bend, the pad biasing the first bend toward the first angle when the bent housing is positioned within the wellbore;

drilling a straight section of a borehole by operating the drill bit while rotating the motor housing; and drilling a curved section of the borehole by operating the drill bit while maintaining the motor housing in a fixed rotational position within the borehole, the curved section being in the direction of the first bend.

16. The method of claim 15, wherein the pad comprises a portion of a centralizer carried by the bent housing adjacent to the first bend.

17. The method of claim 15, wherein the bent housing comprises a second bend that is spaced above the first bend relative to the drill bit, and wherein the guide element comprises the second bend.

18. The method of claim 17, further comprising a pad positioned adjacent to the inside bend surface of the first bend, the pad biasing the outside bend surface toward an inner surface of the straight section of the wellbore and the guide element further comprising the second bend.

19. The method of claim 15, wherein the bent housing comprising first housing section between the drill bit and the first bend, a second housing section between the first bend and the second bend, and a third housing section extending above the second bend relative to the drill bit, each of the first, second and third housing sections lying in a plane.

20. The method of claim 15, wherein the motor housing further comprises a wear pad on an outside surface of at least one of the first bend and the second bend.

21. The method of claim 15, wherein the first bend has an angle of about 1.5 degrees and the second bend has an angle of about 1 degree.

22. The method of claim 15, wherein a respective length of the first, second and third housing sections and a respective angle of the first and second bends result in a side load at the bit of less than about 300 lbs in a straight section of the wellbore.

23. The method of claim 15, wherein a respective length of the first, second and third housing sections and a respective angle of the first and second bends result in a side load at the bit of less than about 150 lbs in a straight section of the wellbore.

24. The method of claim 15, wherein a respective length of the first, second and third housing sections and a respective angle of the first and second bends result in substantially no side loading at the bit in a straight section of the wellbore.

* * * * *